United States Patent [19]

Wenk

[11] 4,306,745

[45] Dec. 22, 1981

[54] BAG SEAL

[75] Inventor: Donald D. Wenk, Brookville, N.Y.

[73] Assignee: American Casting & Mfg. Corp., Plainview, N.Y.

[21] Appl. No.: 113,094

[22] Filed: Jan. 17, 1980

[51] Int. Cl.[3] ..... B65D 55/06

[52] U.S. Cl. ..... 292/318

[58] Field of Search ..... 292/318, 319, 320, 321, 292/322, 316, 317; 24/16 PB

[56] References Cited

U.S. PATENT DOCUMENTS

| | | | |
|---|---|---|---|
| 3,556,575 | 1/1971 | Farkes | 292/31 B |
| 3,597,803 | 8/1971 | Van Neil | 24/16 PB |
| 3,954,294 | 5/1976 | Iwamoto | 292/31 B |
| 4,138,770 | 2/1979 | Barrette | 24/16 PB |

FOREIGN PATENT DOCUMENTS

| | | | |
|---|---|---|---|
| 1257556 | 12/1971 | United Kingdom | 292/31 B |

*Primary Examiner*—Robert L. Wolfe

[57] ABSTRACT

A composite molded plastic bag tie is disclosed for use in sealing bags such as money bags and the like. A bag temperproofing seal is provided having an elongated tie portion for encircling the neck of the bag in combination with a tie holder portion which mounts the tie and which includes a bag gripping portion and an identification tag. The tie, which is a commercially available cable or similar tie including an elongated toothed portion and a pawl portion, is mounted on the tie holder so that the pawl portion of the tie is enclosed in a sealed box which prevents tampering with the pawl so that the tie bag cannot be released or removed from the sealed bag without being destroyed.

19 Claims, 8 Drawing Figures

BAG SEAL

BACKGROUND OF THE INVENTION

The present invention relates to bag ties and more particularly to a molded plastic composite tamperproof bag seal.

There are a variety of bag ties or seals presently used or known in which an elongated tie portion is gripped by a locking device which may not be released without cutting or otherwise destroying the tie thereby indicating that the bag has been tampered with. For many years, these bag ties have included an elongated cord which is sealed in position on the bag mouth by a soft metal slide or other locking member which is deformed by appropriate tools to lock the cord in place. After deformation, the slide cannot be removed without destruction so that the cord itself must be cut to open the bag thereby giving an indication that the bag has been opened.

Other known ties comprise one piece metal or plastic ties wherein a ratchet member engages teeth on the tie during the sealing and whereby it is difficult to release the ratchet member without destroying the tie. These more recent devices when made of metal have been expensive and difficult to apply and the plastic devices have also been relatively expensive and ineffective as a tamperproofing bag tie.

The bag tie of the present invention incorporates a well known cable tie, which is not tamperproof but which is widely available and inexpensive, with an additional molded plastic portion acting as a tie holder. The assembled cable tie and tie holder provide and improved bag tie which is inexpensive, completely tamperproof, and effective in sealing a bag with a suitable identifying tag. In general, this result is obtained by forming the tie holder with the suitable tag portion and a tie mounting strap which includes a bag gripping device as well as a closed box lock arrangement effectively isolating the ratchet portion of the tie so that the bag tie cannot be removed without its destruction.

Accordingly, an object of the present invention is to provide an improved bag tie.

Another object of the present invention is to provide an improved composite plastic bag tie.

Another object of the present invention is to provide a composite molded plastic tie utilizing a known cable tie in combination with a tamperproofing cable tie holder portion.

Another object of the present invention is to provide a molded plastic composite bag tie which is both effective as a tamperproof tie and relatively inexpensive.

Other and further objects of the present invention will become apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein.

DESCRIPTION OF THE PREFERRED EMBODIMENT

As illustrated in the figures, the preferred embodiment of the bag tie 1 comprises an elongated tie such as a cable tie 2 mounted in a tie holder 3.

Figure 5:
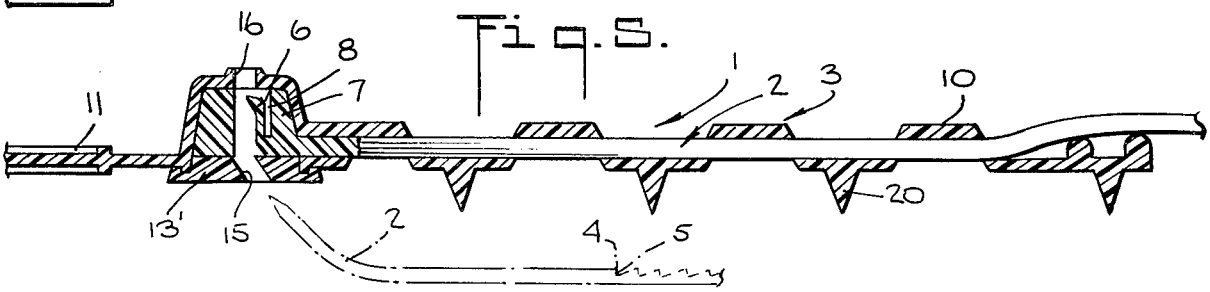
FIG. 5 is a vertical sectional view taken along line 5-5 on FIG. 4.

The cable tie 2 is an elongated plastic member having pawl engaging teeth 4 on at least one side. The teeth 4 have steeply inclined edges 5 facing towards a pawl 6 molded in the pawl frame or inner end portion of the tie 2 for engagement with the pawl member 6, FIG. 5. In the embodiment illustrated, there are teeth 4 on one side of the tie 2 and a single pawl member 6 for engaging the teeth 4. Additional teeth may be provided on the other surface of the tie 2 in which case a second pawl member 6 is provided in the tie. The pawl 6 is molded integrally with the plastic tie 2 and is positioned as illustrated in the drawing with a slot 8 behind the pawl 6 to permit the pawl 6 to flex outwardly as the teeth 4 are advanced and so that the pawl 6 snaps backwardly into tooth engagement as each tooth 4 moves beyond the pawl 6.

The ties 2 are commercially available for a number of uses including use as cable ties. Since a typical pawl member 6 is somewhat exposed, a tie 2 may be released by manipulation of the pawl or pawls 6 so that the tie 2 itself is not tamperproof as a sealing fastener.

Figure 1:
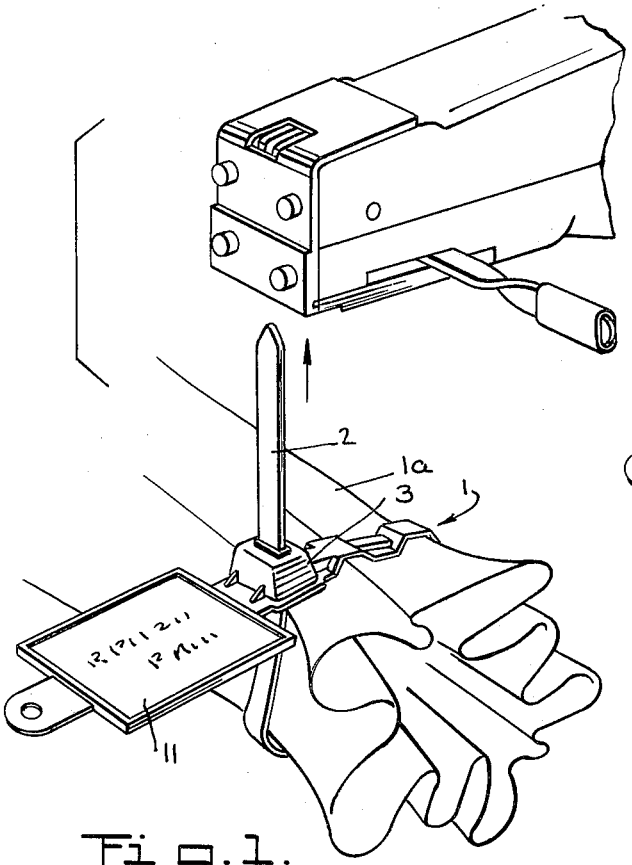
FIG. 1 is a perspective view illustrating a preferred embodiment of the bag tie being fastened onto a bag neck.
Figure 2:
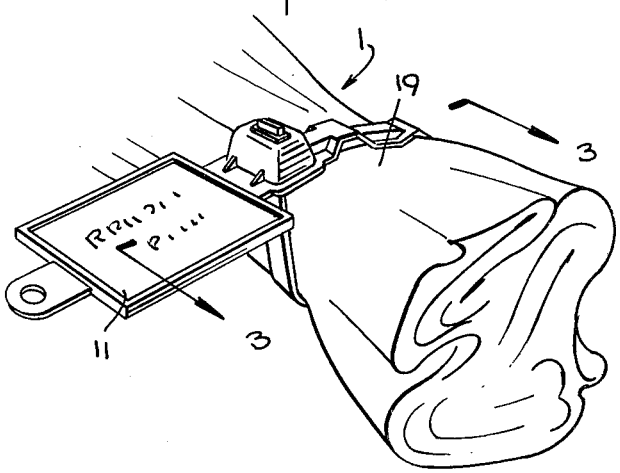
FIG. 2 is a perspective view corresponding to FIG. 1 illustrating the tie in its final fully fastened position.
Figure 3:
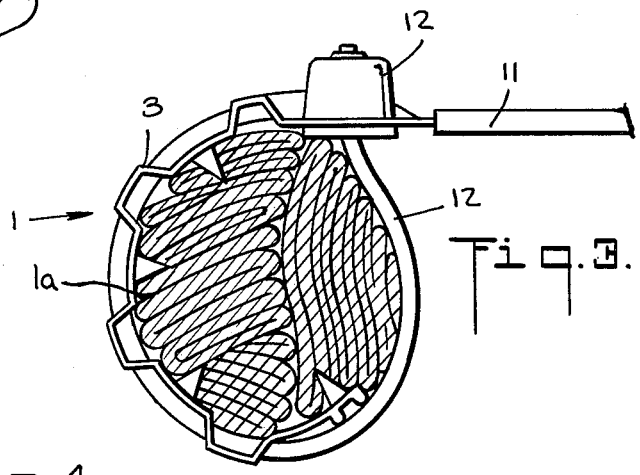
FIG. 3 is a vertical sectional view taken along line 3-3 on FIG. 2.
Figure 4:
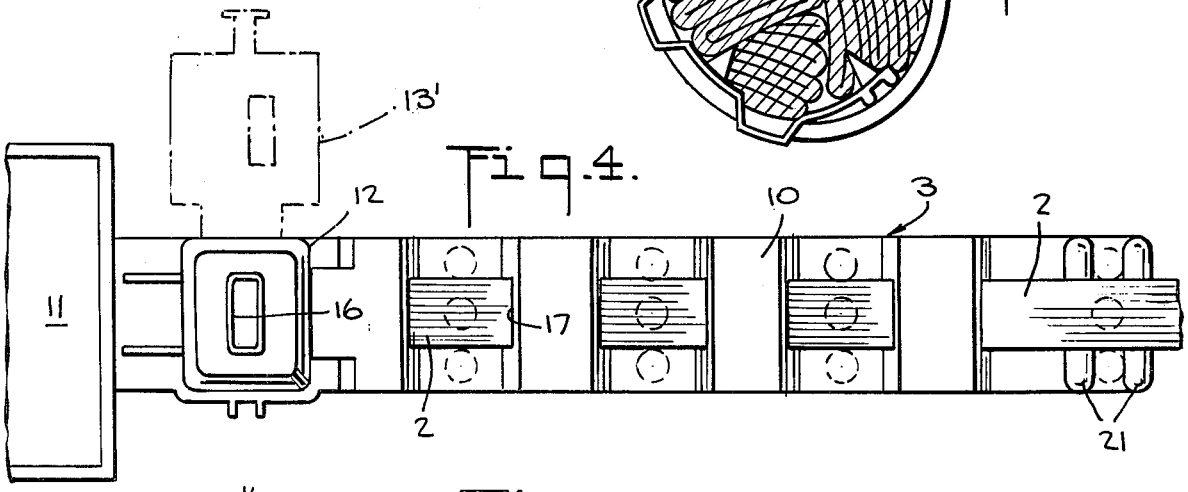
FIG. 4 is a top plan view of the bag tie.
Figures 6, 7, 8:
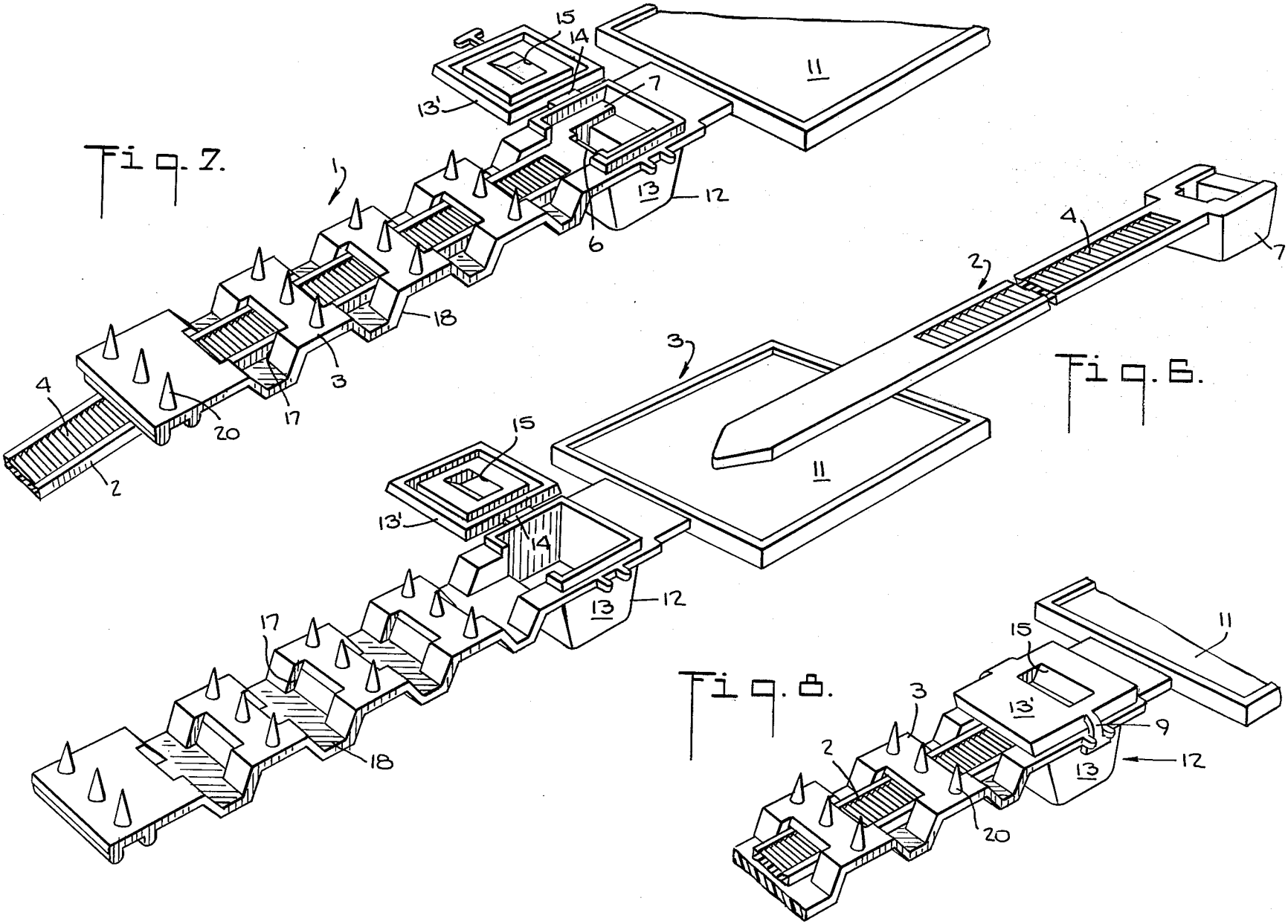
FIG. 6 is an enlarged detailed perspective view of the tie and tie holder before assembly.
FIG. 7 is a corresponding enlarged detailed perspective view after assembly.
FIG. 8 is a corresponding enlarged detailed perspective view of the box portion after sealing.

The tie holder 3 is also molded of plastic and includes an elongated strap portion 10 formed integrally with a tag portion 11. The tag portion 11 may be used to provide a unique indication including an identifying embossed or otherwise applied serial number 14 so that the composite bag tie 1 cannot be readily duplicated. Between the tag portion 11 and the strap portion 10 a housing box 12 is formed for receiving the pawl frame 7 of the tie 2. The box 12 has six walls 13 to fully enclose the pawl frame 7 with the bottom wall 13' being formed with a hinge 14. When the bottom 13' is open as illustrated in FIGS. 6 and 7, the pawl frame 7 is inserted within the box 12. Thereafter, the hinged wall 13 is swung shut and closed with a temporary lock 9 and then heat sealed to form a secure protective box surrounding the pawl frame 7 for preventing tie release without cutting the tie. Tie passing apertures 15 and 16 are provided in the wall 13' and the facing wall 13 respectively In its preferred form the strap portion 10 has a corrugated form with slots 17 formed in the corrugations 18 to receive the tie 2. The corrugated shape of the strap portion 10 also adds to the flexibility of the strap portion 10 permitting it to encircle a substantial portion of the sealed bag neck 19, as illustrated in FIG. 1. A number of pointed teeth 20 are molded on the strap portion 10 for penetrating and interlocking with the fabric or the other material of the sealed bag neck 19. A pair of spaced lugs 21 at the end of the strap portion 10 facilitate the removal of the tie 2 by authorized personnel by permitting the cutting of the tie 2 without injury to the sealed bag neck 19.

A preferred plastics for the bag tie 1 are nylon or polyethylene which may be formulated for high strength while also being relatively flexible. The tie holder 3 plastic may be chosen to be both form-retaining and flexible as well as easily colored and decorated for the purposes already noted and may differ from the plastic used for the tie 2 where strength and flexibility are paramount.

After the bag neck 19 is sealed by passing the tie 2 through the box 12 and by pulling the tie 2 tight, the tie 2 is cut off close to the box 12. This provides a neat seal and prevents reuse of the bag tie 1.

Because the tie holder 3 is manufactured particularly for use as a bag tie and additionally because it may be both uniquely decorated and given a unique serial number, each of the bag ties 1 is readily accounted for and is not easily replaced with an unauthorized seal. At the same time, the composite construction permits the use of the readily available and inexpensive ties which are produced in great volume for a variety of additional uses. The box 12 provides for tamperproofing by concealing the ratchet frame 7 of the tie 2 completely within the sealed box 12 making the pawl elements inaccessible to pins or other tampering tools. The tie holder 3 itself is relatively compact so that it is readily molded as a unitary element including the hinged side 13' of the pawl frame retaining box 12. As contrasted with a conventional metallic or lead seal, the bag tie 1 is less expensive, easier to use without tools, lighter in weight, and accountable by reason of its unique decoration and numbering. The plastic materials are also unobjectionable from a material standpoint, while prior lead and other metal seals have serious disadvantages because of objections recently made to lead and other metallic products as regard possible contamination.

Where seals of differing length are required, the composite design is easily modified by merely using a tie 2 of differing lengths with no change in the tie holder portion or in its method of assembly.

As various changes may be made in the form, construction and arrangement of the parts herein without sacrificing any of its advantages, it is to be understood that all matter herein is to be interpreted as illustrative and not in a limiting sense.

Having thus described my invention, I claim:

1. A composite bag seal for sealing a flexible bag neck comprising the combination of:

a flexible elongated tie having a pawl at one end and ratchet teeth extending along the tie toward the opposite end; and a tie holder having means for retaining the tie including a housing for the tie pawl.

2. The composite bag seal as claimed in claim 1 in which said housing comprises a sealed box-like member with spaced slots for passing the tie.

3. The composite bag seal as claimed in claim 1 in which the tie holder comprises an elongated tie mounting strap extending from a tag portion with the pawl housing positioned intermediate the mounting strap and the tag portion.

4. The composite bag seal as claimed in claim 2 in which said box-like member has one side hinged for facilitating the insertion of the tie pawl.

5. The composite bag seal as claimed in claim 3 in which said tie holder mounting strap is corrugated with spaced slots positioned in the corrugations for receiving the tie.

6. The composite bag seal as claimed in claim 3 which further comprises spaced lugs on the end of said strap opposite to the tag.

7. The composite bag seal as claimed in claim 1 which comprises nylon.

8. The composite bag seal as claimed in claim 1 which comprises polyethylene.

9. The composite bag seal as claimed in claim 3 which further comprises bag engaging points on said tie mounting strap.

10. The composite bag seal as claimed in claim 3 which further comprises indicia on said tag portion.

11. A tie holder for a composite bag sealer for use with an elongated cable tie having ratchet teeth and a pawl comprising the combination of an elongated tie mounting strap, a tag portion, and a housing for the tie pawl connecting said strap and said tag.

12. The tie holder as claimed in claim 11 in which said housing comprises a sealed box-like member with spaced slots for passing the tie.

13. The tie holder as claimed in claim 12 in which said box-like member has one side hinged for facilitating the insertion of the tie pawl.

14. The tie holder as claimed in claim 11 in which said tie holder mounting strap is corrugated with spaced slots positioned in the corrugations for receiving the tie.

15. The composite bag seal as claimed in claim 11 which further comprises spaced lugs at the end of said strap opposite to the tag.

16. The tie holder as claimed in claim 11 which comprises nylon.

17. The tie holder as claimed in claim 1 which comprises polyethylene.

18. The tie holder as claimed in claim 11 which further comprises bag engaging points on said tie mounting strap.

19. The tie holder as claimed in claim 11 which further comprises indicia on said tag portion.

* * * * *